US006334734B1

(12) United States Patent
Attar

(10) Patent No.: US 6,334,734 B1
(45) Date of Patent: Jan. 1, 2002

(54) ONE PIECE REFLECTIVE PAVEMENT MARKER AND METHOD OF MAKING

(76) Inventor: Adil Attar, P.O. Box 3883, Ontario, CA (US) 91761

( * ) Notice: Subject to any disclaimer, the term of this patent is extended or adjusted under 35 U.S.C. 154(b) by 0 days.

(21) Appl. No.: 09/385,091

(22) Filed: Aug. 30, 1999

(51) Int. Cl.[7] ..... E01F 9/06; E01F 9/087
(52) U.S. Cl. ..... 404/16; 404/12
(58) Field of Search ..... 404/12, 14, 15, 404/16

(56) References Cited

U.S. PATENT DOCUMENTS

| | | | | | |
|---|---|---|---|---|---|
| 4,498,733 | A | * | 2/1985 | Flanagan | 404/14 |
| 4,726,706 | A | * | 2/1988 | Attar | 404/14 |
| 5,137,391 | A | * | 8/1992 | Ballesteros | 404/6 |
| 5,425,596 | A | * | 6/1995 | Steere et al. | 404/14 |
| 5,449,244 | A | * | 9/1995 | Sandino | 404/14 |
| 5,470,170 | A | * | 11/1995 | Lindner | 404/9 |
| 5,667,335 | A | * | 9/1997 | Khieu et al. | 404/14 |
| 5,895,725 | A | * | 4/1999 | Caughlin | 428/542.2 |
| 5,897,271 | A | * | 4/1999 | Widmer | 404/14 |
| 5,927,897 | A | * | 7/1999 | Attar | 404/12 |
| 5,957,617 | A | * | 9/1999 | Delamere | 404/11 |
| 5,959,774 | A | * | 9/1999 | Benson et al. | 359/530 |
| 5,975,706 | A | * | 11/1999 | Nakayama | 395/530 |
| 6,045,294 | A | * | 4/2000 | Hansen | 404/14 |

FOREIGN PATENT DOCUMENTS

| | | | | |
|---|---|---|---|---|
| DE | 004112702 | * | 10/1992 | 404/14 |
| GB | WO91/11787 | * | 2/1990 | 404/12 |

* cited by examiner

*Primary Examiner*—Thomas B. Will
*Assistant Examiner*—Raymond Addie

(57) ABSTRACT

A reflective pavement marker integrally molded in one piece structure having retroreflective face and structural body. The marker provide a mean to enhance agglutination to the roadway, if needed when bituminous based adhesive is used by maximizing the base area for adhesive wetting parameter. The reflective face and the structural body integrally made of high impact and abrasion resistance thermoplastic. Recessed reflective cells within the reflective face tend to minimize contact with tires and other abrasive roadway elements.

10 Claims, 4 Drawing Sheets

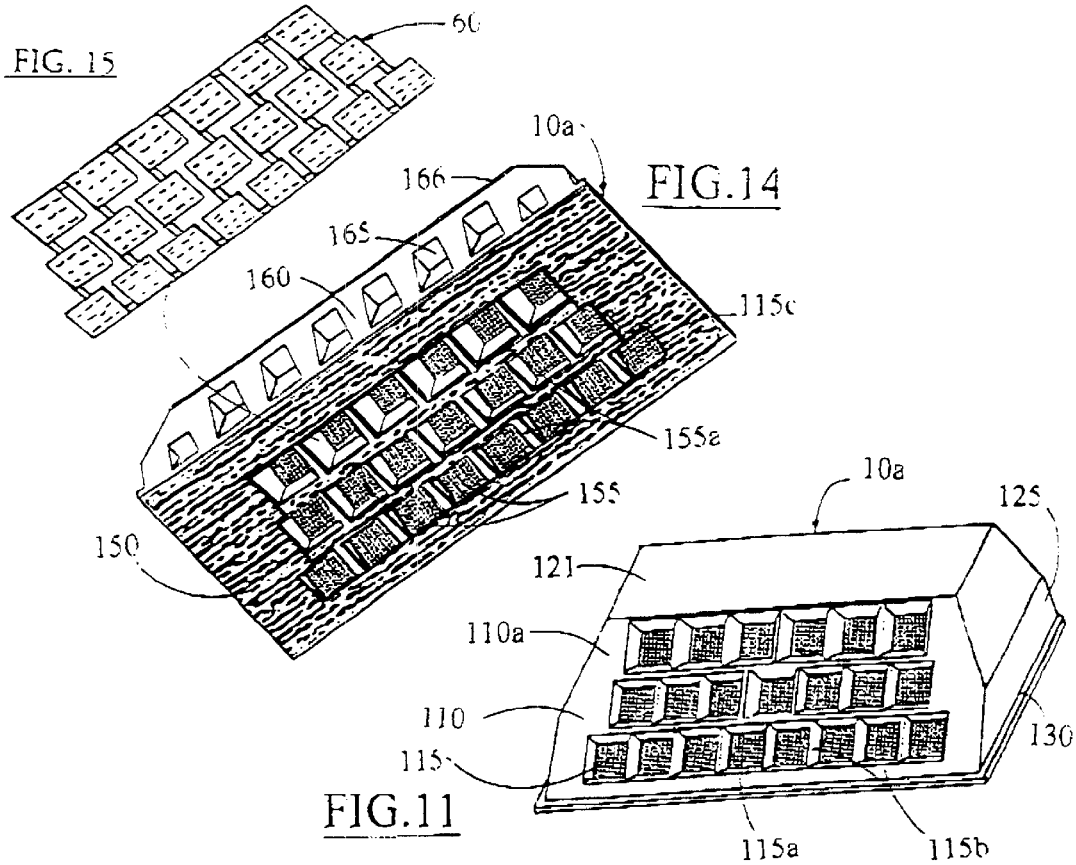
FIG. 15
60
10a
166
165
160
115c
155a
155
150
FIG.14
10a
125
121
110a
110
115
130
115a
115b
FIG.11
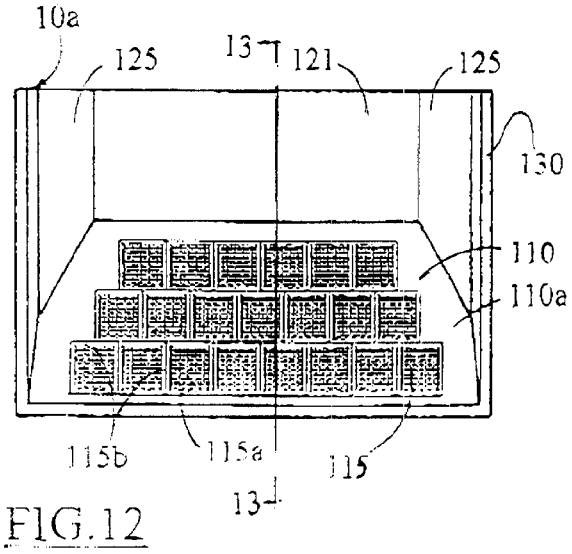
10a
125
13
121
125
130
110
110a
115b
115a
115
13
FIG.12
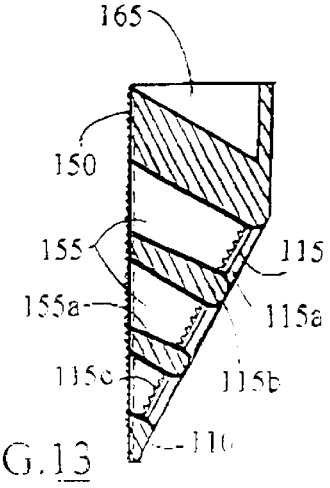
165
150
155
115
155a
115a
115c
115b
110
FIG.13

ONE PIECE REFLECTIVE PAVEMENT MARKER AND METHOD OF MAKING

BACKGROUND OF THE INVENTION

1. Field of the Invention

This invention relates to the retroreflective roadway markers that are used for traffic lane delineation and in particular, to markers with enhanced reflectivity and abrasion resistant.

2. Related Art

Roadway markers are adhered to pavements along centerlines, edge lines, lane dividers or guardrail delineators. Other roadway markers are used as temporary lane dividers in temporary constructions, detours or prior to permanent marking of newly paved roadways.

Since 1965, the most commonly used retroreflective roadway markers are based on Heenan U.S. Pat. No. 3,332,327 or Balint U.S. Pat. No. 3,409,344.

Typically, this type of markers are produced in a process consisting of four to five steps:

First, injection molding of a thermoplastic shell, either integrally molded with the reflective face, or the reflective faces welded on a corresponding open recesses within the shell. The reflective face, having 350 or more cube corner reflective elements on each reflective face of the shell.

Secondly, either the cube corner reflective elements within a shell or the entire inside surface of the shell coated with a reflective sealer by a process known as vacuum in metalizing. This metallic sealer needed to seal the cube comer reflective elements so they retain part of their retroreflectivness prior to the next step, of filling the shell with a thermosetting resinous material, such as epoxy or polyurethane. This resinous filler material encapsulate the metalized cube corner reflective elements and give the marker the structural body.

Finally, a layer of relatively course sand or glass beads dispersed over the top surface of the filler material (this top surface will be the marker's base) prior to solidification of the filler material. Part of the sand particles will remain partially protruding above this planar surface of the marker base, thereby increase the adhesive welding parameter of the base surface. This will improve adhesion to substrate, regardless of the type of adhesive used. This type of markers worked well for six or seven months, however, due to poor abrasion and impact resistant of the thermoplastic shell, nearly 60% of the reflectivity is lost thereafter. Also, incompatibility of the shell material to the resinous filler material, causes pealing of the reflective face or the shell, thereby losing retroreflectivity. Several attempt were made to improve abrasion resistant of the reflective face. One was the use of thin layer of untempered glass as disclosed in U.S. Pat. No. 4,340,319. Another attempt was the use of polymeric coating of the reflective face, as disclosed in U.S. Pat. No. 4,753,548 (Forrer). These abrasion resistant coating proving to be expensive and tend to reduce retroreflectivity.

Other major development in the pavement marker art have been made in the attempt to eliminate the use of the metalized sealer for the cube corner reflective elements. This has been achieved by dividing the inside surface of the reflective face into reflective cells, each cell will have several cube corner reflective elements, the cells isolated from each other by partition and load carrying walls. The entire reflective face welded to corresponding recesses within a hollowed body.

This method is disclosed in U.S. Pat. No. 4,227,772 (Heenan); U.S. Pat. Nos. 4,232,979; and 4,340,319 (Johnson et al); U.S. Pat. No. 4,498,733 (Flanagan). These markers proved to be superior in reflectivity, however, lack of structural strength and poor adhesion cause short life cycle for this type of markers.

This applicant successfully developed two multi-cell reflective roadway markers. One roadway marker utilizes raised rhombic shaped abrasion reducing and load transferring raised ridges which act to intercede abrasion elements and impact load, the shell filled with epoxy, the marker body having a base with large wetting parameter for shear and flexural strength , as disclosed in U.S. Pat. No. 4,726,706. The second roadway marker of this applicant, U.S. Pat. No. 5,927,897 developed a mean to increase the abrasion resistant of the reflective face by coating the reflective face with diamond-like film and by having holding pins extending from the partition walls into the body, the holding pins sealed by the filler material; this works very effectively. All of the above reflective pavement markers are incorporated herein by reference in their entireties. Applicant present goal to have a roadway marker with high reflectance, abrasion resistant, low cost, marker base area with good welding parameter and very simple yet consistent process to manufacture.

SUMMARY OF THE INVENTION

This invention provide a novel one piece raised roadway marker that comprises a monolithically injected body, together with one or two reflective faces and a base having large adhesive welding parameter for better adhesion to the pavement and higher resistance to flexural stresses .

The primary object of this invention is eliminate the multi steps process in prior arts for making reflective and non-reflective pavement markers while retaining maximum base surface area. Another objective of this invention is to provide a raised roadway marker made of high impact and abrasion resistant material with high impact resistance and good quality reflective index.

The present invention further provide a method of making one piece raised roadway marker of any desirable shape and configuration such as a marker with truncated body or one piece marker with a body having two rumble portions integrally made with two reflective faces and scalloped recess in-between with rectangular textured base.

In accordance with still further aspect of this invention, the marker can be made for one or two way traffic usage, having integrally built-in reflective faces, this will cost considerably less to install to the roadway, or two multi colored parts can be welded together, each with one reflective face opposite the other.

BRIEF DESCRIPTION OF THE DRAWINGS

The advantages and unique features of this invention will be better understood by reference to the drawings. These drawings are schematics, no scale used. In the drawings:

FIG. 11 is an isometric view of yet another embodiment of one-piece marker of the invention;

FIG. 12 is a plan view of the marker in FIG. 11;

FIG. 13 is a cross section view taken along the line 13—13 in FIG. 12;

FIG. 14 is isometric view of the marker in FIG. 11 showing the base surface and the back portion;

FIG. 15 is an isometric view of a sealing plate for the base of marker in FIG. 11;

DESCRIPTION OF THE PREFERRED EMBODIMENTS

Figure 1:
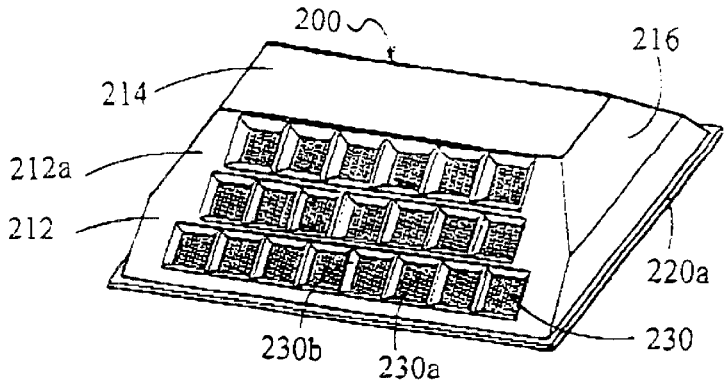
FIG. 1 is an isometric view of one of the preferred one piece pavement marker of the invention.
Figure 4:
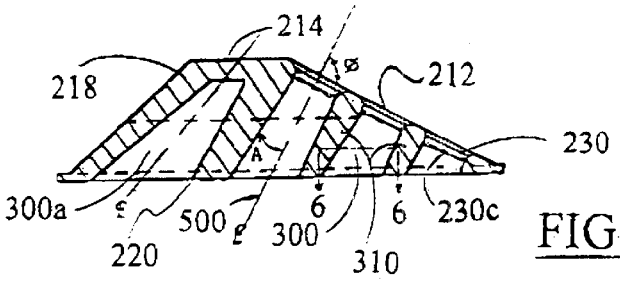
FIG. 4 is a cross section view taken along the line 4—4 in FIG. 2.

Enhanced reflectivity, durability, cost effectiveness and simplified production method can be achieved by eliminating major steps or processes used in previous arts for the manufacturing of reflective and non reflective pavement markers. This invention is satisfying the above conditions.

This invention eliminate the process of metalizing, the reflective face; eliminate the step of welding a backing sheet to the reflective face; eliminate filling the marker body (shell) with inert filled resinous material or welding a unitarily molded block with flattened base to a shell; eliminate a lens mounting structure and a base layer added to marker body. This invention, simply developed a process of making a reflective pavement marker in one step process.

Referring to FIGS. 1 through 6 represent one of the preferred embodiment of a durable one piece reflective marker designated by the number 200 which comprises an integrally cast body 210 with at least one reflective face 212. Body 210 has a top portion 214, two inclined sides 216, two inclined planar faces 218 and 212 facing traffic with at least one (212) is a reflective face and a textured and grooved planar base surface 220 with an extended base portion 220*a* for added adhesion area. Marker 200 can be of any desired dimensions or shapes.

The inclined planar reflective face 212 integrally have planar surface 212*a,* multiple of reflective cells 230 and partition ribs 230*b* separating cells 230 from each other. Reflective cells 230 can be of any desired shape or size. Various reflective cells and cube corner reflective element designs available for use in this marker. The following U.S. Patents provide suitable cell and cube corner element designs, therefore, all of the following arts are incorporated as reference in their entireties: U.S. Pat. No. 3,712,706 to Stamm, U.S. Pat. No. 3,924,929 to Holmen, U.S. Pat. No. 4,208,090 to Heenan, U.S. Pat. Nos. 4,232,979 and 4,340,319 to Johnson, U.S. Pat. No. 4,498,733 to Flanagan, U.S. Pat. Nos. 4,726,706 and 5,927,897 to Attar. Reflective cell 230 has an outside planar surface 230*a* slightly recessed with respect to the planar surface 212*a* and the vertex of the partition ribs 230*b*. Preferably, the cell's outside surface 230*a* would be recessed anywhere between 0.005 to 0.020 inch below planar surface 212*a* to eliminate contact with automobile tires. Each reflective cell 230 have an inside surface 230*c* integrally built with multiple of protruding cube corner reflective elements. Each cell's inside surface 230*c* is isolated from each other by integrally built load carrying interior walls 310 which are tapered outwardly, integrally forming hollow recesses 300 directly beneath each inside surface 230*c* of the reflective cell 230. Each hollow recess 300 is formed corresponding to the size and shape of the cell's inside surface 230*c* with the protruding cube corner reflective elements, said hollow recesses 300 positioned with their centerlines 500 near perpendicular to the cell's outside planar surface 230*a,* preferably this angle to be between 75 to 105 degrees. Each interior wall 310 form an angle (A) equal or less than 5 degrees with respect to each centerline 500.

Hollow recesses 300*a* are used when the desired marker is to have only one side with reflective face, as shown in marker 200. Both hollow recesses 300 and 300*a* will be tapered outwardly and open through the textured and grooved planar base surface 220 thereby forming air gab beneath each individual reflective cell 230. Hollow recesses 300 and 300*a* can have some of the walls 310 formed with arcuate grooves 310*a* for added reflectivity, surface opaqueness, enhancing daytime reflectivity and improving the structural strength of the marker.

Marker 200 is made of a high impact resistance, transparent polymeric material, with ultra violet light stability. Thermoplastic such as high impact resistance acrylic, polycarbonate or any other high impact resistance engineered polymer is suitable for this marker. Reflective face 212 can have either three raw, two raw or one raw of reflective cells 230, depending on the desired size, shape or height of marker 200 and the size and shape of the reflective cells 230 being used.

For applications in sunny and hot environment, where bituminous hot-melt adhesive may be used, to agglutinate marker 200 to the roadway. the low melting point of such adhesive material may lead to adhesive failure known as cookie cutter effect, where a marker agglutinated to the pavement, may be forced by traffic impact load to move away from it's intended location on the roadway.

The science of material welding teach us that one of the primary variables to good adhesion of two surfaces is the total surface area to be wetted by the adhesive (welding) material, this area can be called the (welding parameter), therefore, we can improve adhesion of marker 200 to a substrate and perhaps more effectively than the arts in U.S. Pat. No. 3,332,327 to Heenan or U.S. Pat. No. 5,340,231 to Steere. This improvement in welding parameter can be achieved by using one of various arcuate shapes with discontinuous length, grooved perpendicular to traffic direction. Each groove can have length of about an inch or less and textured surface, preferably by sand blasting the corresponding part of the tooling. The width or depth of such grooves should not be more than 0.10 inch in-depth.

It can be proving that the welding parameter can be increased considerably within the same marker base area despite the open ends of the hollow recesses 300 and 300*a,* as an example, consider marker 200 to have a base width of 4 inches and depth of 2.75 inches, therefore, the planar base surface area=2.75×4.0=11 sq. inches. In one of the preferred embodiment, assume the surface area for the same base area having 30 grooves, each having 0.09 inch diameter and 4.0 inch length, subtract 29 open end areas of hollow recesses 300 and 300*a,* each having open end area=0.08 sq. inch, hence, the net surface area=(30×4.0×0.09×3.14/2)−(0.08×29)=14.6 sq. inches. This is considerably larger than the same planar area with no grooves. Marker 200 will have even larger area as welding parameter by using short and discontinuous grooves, each near inch in length with textured surface. In addition, planar base surface 220 can have an extended portion 220*a* for added adhesive grip.

Figure 5:
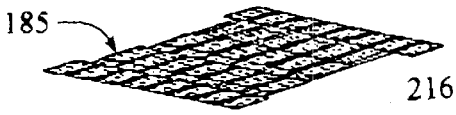
FIG. 5 is an isometric view of a thin plate that can be used to seal the ends of hollow recesses.
Figure 3:
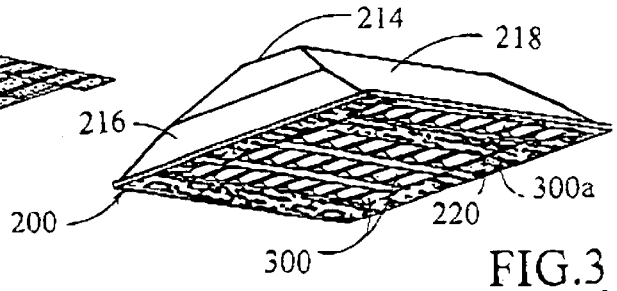
FIG. 3 is another isometric view of pavement marker in FIG. 1 showing the base portion with grooved surface and the end opening for the hollow recesses.
Figure 2:
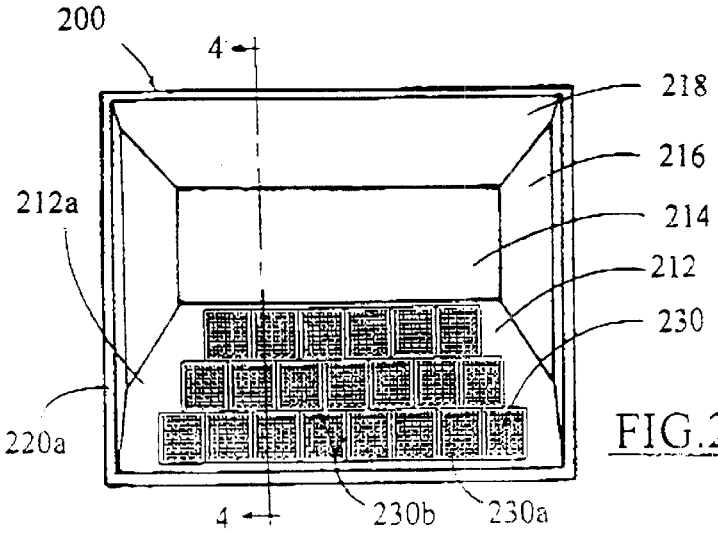
FIG. 2 is a plan view of the pavement marker illustrated in FIG. 1.
Figure 6:
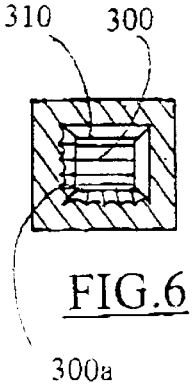
FIG. 6 is a section view taken along the line 6—6 in FIG. 4 showing partly grooved surfaces of a hollow recess.
Figure 7:
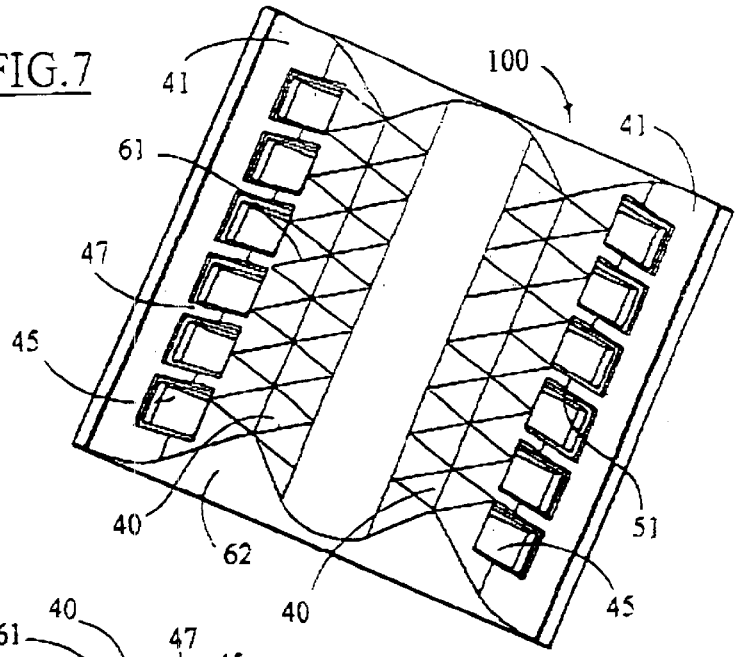
FIG. 7 is an isometric view of another preferred embodiment of one-piece marker of the invention.
Figure 10:
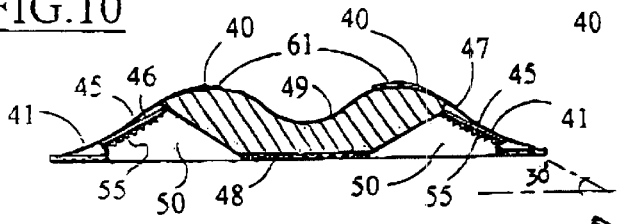
FIG. 10 is a cross section view taken along the line 10—10 in FIG. 9.
Figure 8:
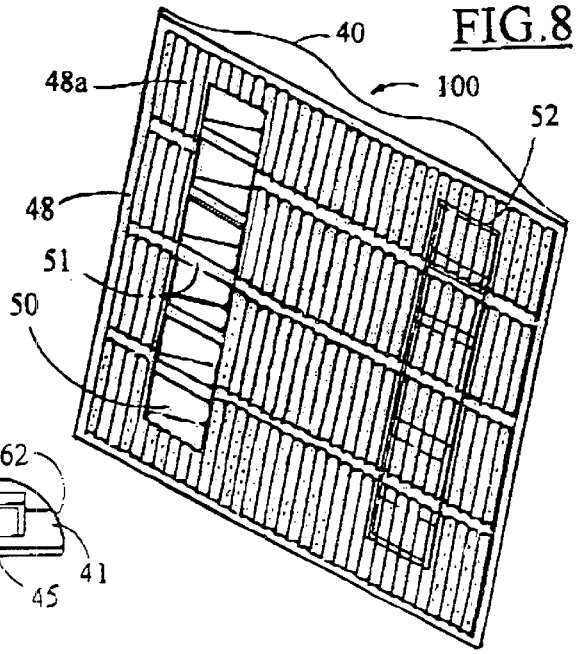
FIG. 8 is another isometric view of marker in FIG. 7 showing the base surface.
Figure 9:
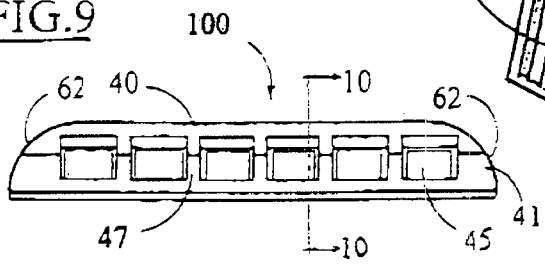
FIG. 9 is an elevation view of the marker in FIG. 7 showing the cursed sides and reflective cells.
Figure 16:
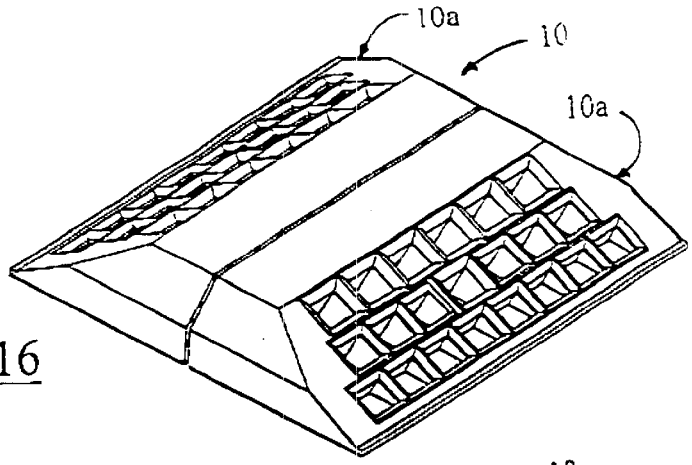
FIG. 16 is an isometric view of two welded markers of FIG. 11.
Figure 17:
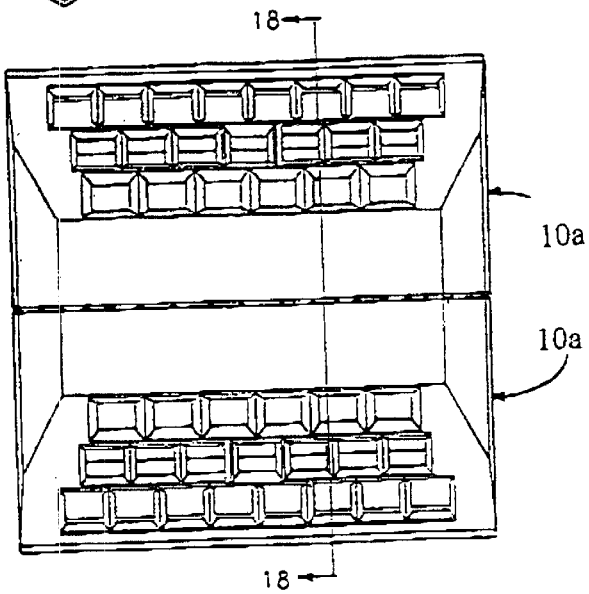
FIG. 17 is a plan view of the marker in FIG. 16.
Figure 18:
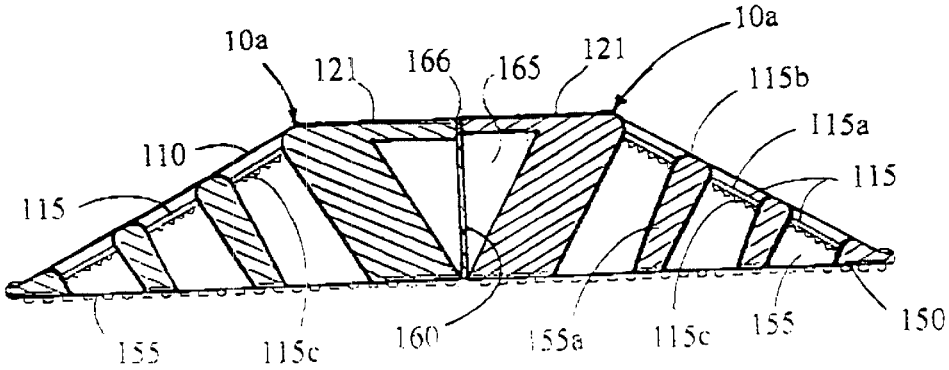
FIG. 18 is a cross section view taken along the line 18—18 in FIG. 17.

Yet another mean to improve the adhesive welding parameter of the grooved planar base surface 220 is by capping the open ends of hollow recesses 300 and 300*a* by a corresponding shaped plate 60 with corresponding size caps 65 and ties 66, as in FIG. 5. Unlike previous arts such as. in U.S. Pat. No. 5,340,231 to Steere and U.S. Pat. No. 5,667,335 to Khieu, the caps 65 used in the present invention will have textured discontinuous grooves and will be agglutinated to each corresponding hollow recess 300 and 300*a.* in such away leaving portion of each cap 65 recessed either slightly recessed or protruded within each opening of the hollow recesses 300 and 300*a* at the planar base surface 220. The recessed depth shall be less than 0.10 inch from the planar base surface 220.

In some application where the desired reflective marker is to have two opposite reflective faces integrally made within one piece body, a truncated body design can be used similar to marker 200.

Another preferred embodiment is marker 100, as shown in FIGS. 7 through 10. The body shape having one or two convex portions 40, each having concave curve shaped front surface 41, said front surface 41 integrally made having multiple of planar rectangular reflective cells 45. Each reflective cell 45 integrally having an outside planar reflective surface 46, which is slightly recessed below the vertex of partition ribs 47 separating reflective cells 45 from each other. Each integrally made cell 45 within marker body 100 having the outside planar surface 46 inclined approximately 30 degrees with respect to the marker planar base 48. Each reflective cell 45 integrally having an inside surface 55 with protruding cube corner reflective elements. Marker 100 have two curved sides 62.

The two convex portions 40 are connected with a concave portion 49, said concave portion 49 need to be wide enough proportionately to marker's height to accommodate the space needed for the injection molding slides forming the cube corner reflective elements within each reflective cell 45 through the open end of each corresponding hollow recess 50. Hollow recess 50 form an air gap beneath the cube corner reflective elements within the inside surface 55 of each cell. Each hollow recess is having centerline near perpendicular to the corresponding outside planar surface 46 of cell 45.

Hollow recesses 50 are separated from each other by partition and load carrying walls 51.

The planar base portion 48 of marker 100 has discontinuous curved grooves 48*a* with less than 0.09 inch in depth. The entire surface of the base 48 is textured to maximize the (adhesive wetting) welding parameter. The open ends of hollow recesses 50 can be capped with thin polymeric plate 52.

Marker 100 may have slightly raised ridges 61 on the outside surface for added protection, such raised ridges forming either rectangular or rhombic shape grids on the convex portions 40. The height of said raised ridges will be less than 0.010 inch.

In other applications where the desired marker to have two reflective faces with different color, shorter body depth, lower height or maximum welding parameter at the marker base area. In this case, an embodiment such as marker 10 and 10*a* are preferred, as illustrated in FIGS. 11 through 18. Marker 10 comprises of two identical shaped marker 10*a,* welded or glued together. The two sides of marker 10 can be of same color or two different colors.

Each marker 10*a* integrally consist of one inclined reflective face 110, a top portion 121, two multi-angled or curved sides 125, a planar rectangular base surface 150 with textured discontinuous grooves, said base surface 150 can have an extended periphery portion 130; and back portion 160 forming perpendicular angle with respect to the marker planar base surface 150, said back portion 160 have hollow cavities 165.

The reflective face 110 integrally has a planar surface 110*a,* multiple of reflective cells 115 and arcuate partition ribs 115*b*. Reflective cell 115 have outside planar surface 115*a* slightly recessed below the vertex or partition ribs 115*b* and an inside surface 115*c* with protruding cube corner reflective elements. Each inside surface 115*c* is open within a hollow recess 155.

Hollow recesses 115 open through the base surface 150. The centerline of each hollow recess 155 is near perpendicular to the corresponding cell's outside planar surface 115*a*. Each hollow recess 155 separated from each other by an outwardly tapered partition and load carrying walls 155*a*.It can easily be shown that marker 10 can have any desired shape or size and the reflective face can have either one raw or multipie raw of reflective cells, each cell having either hexagonal, rectangular, rhombic or circular shape or a marker with round base and spherical surface.

When additional welding parameter (area) is needed for the base surface 150, the entire open ends of hollow recesses 155 can be capped by correspondingly shaped plate 60, as in FIG. 15, with multiple caps 65 that can be welded onto it's corresponding size and shaped ends of hollow recesses 155.

Caps 65 connected to each other by multiples of thin ties 66, each with highly porous surface for adhesive penetration.

Marker 10 can be made welding the back side 160 of two identical parts 10*a* that can be produced connected by a thin wedge 166. Wedge 166 can be tore apart so that two parts 10*a* with contrasted colors can be welded at the back side 160, forming marker 10.

Various embodiments of this invention can have improved abrasion resistant body, reflective cells or both, by applying one of various arts available in abrasion resistant coating. Preferably, using vacuum evaporator deposition of either silicon dioxide (SIO2) layer or a diamond like carbon layer, as in U.S. Pat. No. 5,927,897 to Attar; U.S. Pat. No. 4,060,660 to Carlson and U.S. Pat. No. 4,383,728 to Kieser, all of which are incorporated herein as reference in their entireties.

It is understood that various changes or modifications can be made within the scope of the appended claims to the above-preferred embodiments without departing from the scope and the spirit of the invention. Therefore, the invention can be practiced otherwise than as specifically described herein.

What is claimed is:

1. A monolithically formed one-piece reflective pavement marker comprising;

a substantially hollowed pavement marker body, said marker body having a top, multiple sides, a planar base surface witn textured discontinuous grooves, two inclined faces, at least one of said faces being a reflective face, said reflective face integrally includes planar inside and outside surfaces with multiple reflective cells, said inside surfaces of reflective cells are open within hollow cavity air gaps immediately beneath said reflective cells, said hollow cavity air gaps being defined by multiple load carrying partition walls, said reflective cells can have any desired shape or size, said pavement marker being formed from high impact-resistant, transparent, polymeric material, said monolithically formed one-piece reflective pavement marker further comprising:

plurality of integrally formed cube-corner reflective elements protruding from said inside surfaces of said reflective cells, said inside surfaces of reflective cells are open within said hollow cavity air gaps, wherein said integrally formed cube corner reflective elements provide said monolithically formed pavement marker the retro-reflectivity of light from oncoming traffic, said integrally formed load carrying interior walls are disposed rearward starting at the periphery of said inside surfaces of said reflective cells, said hollow cavity air gaps each having a centerline near perpendicular to the corresponding outside planar surface of said reflective cells, said hollow cavity air gaps having open ends at the planar base surface, said load carrying interior walls having slightly tapered surfaces starting at a point immediately adjacent to the periphery of the inside surfaces of said reflective cells, said load carrying interior walls are integrally formed having either smooth wall surfaces or surfaces with textures and arcuate grooves, said open ends of hollow cavities at the planar base surface can be sealed with a polymeric thin cap, whereby said load carrying interior walls define said inside surfaces of said reflective cells, provide the structural support for said hollowed pavement marker and defining the hollow cavity air gaps inclusively within said one-piece pavement marker.

2. The monolithically formed one-piece reflective pavement marker as defined in claim 1, wherein said pavement marker can have a truncated shape exterior surface with one reflective face, load carrying interior walls and a textured planar base surface, said reflective face integrally formed with reflective cells, said load carrying interior walls retaining said cube-corner reflective elements within said hollow cavity air gaps of said pavement marker.

3. The monolithically formed, one-piece reflective pavement marker as defined in claim 1, wherein the open ends of said hollow cavity air gaps at the planar base surface can be capped and sealed with a correspondingly sized and shaped polymeric thin cap, said cap having a textured and grooved surface, said cap sonically welded to the end portions of said load carrying interior walls within a recessed area of said planar base surface.

4. The monolithically formed one-piece reflective pavement marker as defined in claim 1, wherein either the entire exterior surface or said at least one reflective face of said pavement marker is coated with chemical vapor-deposited, abrasion resistant, layer of either silicone dioxide or hard carbon film.

5. The monolithically formed one-piece reflective pavement marker as defined in claim 1, wherein the planar base surface further comprises an integrally extended base portion, which extends beyond the periphery of the top surface of said pavement marker body.

6. A monolithically formed reflective pavement marker comprising:

two parts, each part having one, inclined, planar, reflective face having multiple reflective cells;

a planar top surface, two multi angled or arcuate sides, a planar base surface including textured grooves, a back side having a perpendicular angle with respect to the planar base surface, said backside having hollow cavities, said two parts connected by a thin wedge, said reflective cell having planar inside and outside surfaces to intercept light, said pavement marker being formed of high impact resistant transparent polymeric material;

each of said two parts further comprising:

multiple cube-corner reflective elements integrally protruding from said inside surface of said plurality of reflective cells, said multiple cube-corner reflective elements being disposed within hollow cavity air gaps, said cube corner reflective elements being adapted to provide retro reflective light toward on coming traffic, said hollow cavity air gaps having open ends at the planar base surface; load carrying interior walls which are an integral part of the inside surface of said inclined planar reflective face, said load carrying interior walls provide structural support and define said hollow cavity air gaps, said reflective cells can have either rectangular shapes, hexagonal, rhombic or circular shapes, said hollow cavity air gaps each having a centerline near perpendicular with respect to the corresponding outside planar surface of said reflective face, said interior walls tapered outwardly starting at a point immediately adjacent to the periphery of the inside surfaces of said reflective cells, said open ends of hollow cavity air gaps at the planar base surface can be sealed with a thin, polymeric, cap; said pavement marker further comprises a chemical vapor deposited, abrasion-resistant film of either hard carbon or silicone dioxide film, covering the reflective face or the outside surface of said pavement marker.

7. The monolithically formed reflective pavement marker as defined in claim 6, wherein the planar outside surfaces of said reflective cells can be at the same level of planar reflective face or be defined by partition ribs, said planar outside surfaces of reflective cells can be recessed about 0.001 to 0.01 inch bellow the apex of said partition ribs, said partition ribs reduce automobile tire contact with said reflective cells.

8. A reflective pavement marker comprising;

said two parts of said pavement marker of claim 6, can be sonically welded or glued at the back sides there of, thereby providing a pavement marker with two opposing planar reflective faces, said pavement marker with two reflective faces can have the two reflective faces with similar color or dissimilar colors for each side of said marker.

9. The monolithically formed reflective pavement marker as defined in claim 6, wherein the open ends of said hollow cavity air gaps at the planar base surface can be capped and sealed with a correspondingly sized and shaped thin cap made of compatible polymeric materials, each cap having a textured and grooved surface.

10. The monolithically formed reflective pavement marker as defined in claim 6, wherein, said load carrying interior walls are integrally formed having either smooth surface walls or walls having arcuate grooves to increase color appearance and added structural strength.

* * * * *